US010092920B2

(12) United States Patent
Le Maner

(10) Patent No.: US 10,092,920 B2
(45) Date of Patent: Oct. 9, 2018

(54) SPRAYING HEAD

(71) Applicant: APTAR FRANCE SAS, Le Neubourg (FR)

(72) Inventor: Francois Le Maner, La Vallee Montaure (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/782,484

(22) PCT Filed: Apr. 4, 2014

(86) PCT No.: PCT/FR2014/050814
§ 371 (c)(1),
(2) Date: Oct. 5, 2015

(87) PCT Pub. No.: WO2014/167224
PCT Pub. Date: Oct. 16, 2014

(65) Prior Publication Data

US 2016/0339464 A1 Nov. 24, 2016

(30) Foreign Application Priority Data

Apr. 8, 2013 (FR) ..... 13 53102

(51) Int. Cl.
*B05B 11/00* (2006.01)

(52) U.S. Cl.
CPC ..... *B05B 11/0072* (2013.01); *B05B 11/0067* (2013.01); *B05B 11/3047* (2013.01); *B05B 11/3077* (2013.01)

(58) Field of Classification Search
CPC ..... B05B 11/0005; B05B 11/0067; B05B 11/0072; B05B 11/3047; B05B 11/3073; B05B 11/3076; B05B 11/3077
See application file for complete search history.

(56) References Cited

U.S. PATENT DOCUMENTS 3,490,658 A 1/1970 Schwartzman
4,082,223 A * 4/1978 Nozawa ..... B05B 11/3009 222/321.8

(Continued)

FOREIGN PATENT DOCUMENTS

EP 0 131 501 A1 1/1985
EP 0 815 946 A2 1/1998

(Continued)

OTHER PUBLICATIONS

International Preliminary Report on Patentability dated Nov. 5, 2015, issued by the International Bureau in corresponding International Application No. PCT/FR2014/050814.

(Continued)

*Primary Examiner* — Darren W Gorman
(74) *Attorney, Agent, or Firm* — Sughrue Mion, PLLC

(57) ABSTRACT

A spray head for a fluid dispenser device, having a body with an expulsion channel terminated by a dispenser orifice, an insert in the expulsion channel, the end of the insert is co-operates with the downstream end portion of the expulsion channel to define a spray profile. The insert includes an elastically-deformable portion adapted to deform to absorb and/or compensate for variations in the dimensions of the body and/or insert, and/or to compensate for deformations and/or movements of the insert. The elastically-deformable portion of the insert has tabs that are axially and/or radially deformable, and/or an overmolded portion made of deformable material, and/or one or more radial openings that pass through the insert, and/or at least one sloping strip of deformable material.

10 Claims, 2 Drawing Sheets

(56) References Cited

U.S. PATENT DOCUMENTS 4,273,290 A * 6/1981 Quinn ..... B05B 1/3436 239/333
4,365,751 A * 12/1982 Saito ..... B05B 11/3011 222/212
4,624,413 A * 11/1986 Corsette ..... B05B 1/12 239/333
4,773,571 A * 9/1988 Hagan ..... B67D 1/0456 137/852
4,801,093 A 1/1989 Brunet et al.
4,830,284 A * 5/1989 Maerte ..... B05B 11/0067 222/321.6
4,989,790 A * 2/1991 Martin ..... B05B 1/3447 239/483
5,046,645 A * 9/1991 Hagan ..... A61M 39/26 137/516.29
5,074,440 A 12/1991 Clements et al.
5,368,201 A * 11/1994 Fuchs ..... B05B 11/0027 222/162
5,439,178 A 8/1995 Peterson
5,622,318 A 4/1997 Bougamont et al.
5,720,419 A * 2/1998 Li ..... B05B 11/0016 222/321.2
5,988,449 A 11/1999 Fuchs et al.
6,443,370 B1 * 9/2002 Brulle ..... B05B 1/3436 222/321.6
7,775,405 B2 * 8/2010 Sweeton ..... B05B 11/0064 137/540
2015/0139834 A1 5/2015 Gerbron et al.

FOREIGN PATENT DOCUMENTS

EP 0 930 102 A1 7/1999
GB 2 007 807 A 5/1979
WO 2012/152901 A1 11/2012

OTHER PUBLICATIONS

International Search Report for PCT/FR2014/050814 dated Oct. 17, 2014.

* cited by examiner

SPRAYING HEAD

CROSS REFERENCE TO RELATED APPLICATIONS

This application is a National Stage of International Application No. PCT/FR2014/050814 filed Apr. 4, 2014, claiming priority based on French Patent Application No. 1353102 filed Apr. 8, 2013, the contents of all of which are incorporated herein by reference in their entirety.

FIELD OF INVENTION

The present invention relates to an improved spray head and to a fluid dispenser device incorporating such a spray head.

BACKGROUND

For certain types of fluid dispenser device with which it is desired to dispense fluid in the form of a fine spray, it is known to form a spray profile upstream from the spray orifice, which spray profile generally comprises a swirl chamber that is fed by one or more swirl channels. Nowadays, that type of dispenser device is widely used in a large number of fields, and in particular in the fields of pharmacy, perfumery, and cosmetic. Document EP 0 131 501 discloses a spray head for a fluid dispenser device, with a cylindrical insert of constant section inserted in the expulsion channel. The end face of the insert is perpendicular to the axis of said insert and co-operates with the end wall of the expulsion channel so as to define a spray profile comprising a swirl chamber and one or more swirl channels that connect the expulsion channel to said swirl chamber.

However, in some circumstances, that type of device may present drawbacks. Thus, ISO standard 20072, entitled "Aerosol drug delivery device design verification", includes a chapter relating to the ability to withstand impacts, commonly known as "drop tests". In summary, the test requires the dispenser device to be dropped from a height of at least 1 meter (m), in three starting orientations, with and without a protective cap. The risk of dropping the spray head appears very clearly as one of the main risks for the integrity of the dispenser device. Although the center of gravity of dispenser devices generally causes it to turn while dropping, the risk of impact on the axis of the spray head is probable. From experience, that type of impact generally causes changes in the interference between the inner nozzle and the swirl chamber. In particular, the inner nozzle may either move away from the spray profile, or, on the contrary, may compress it, preventing said spray profile from subsequently operating in reliable manner, resulting in poor spray quality.

Another problem that may occur with inner nozzles relates to the mechanical stresses between the components. Such stresses, in particular in materials of the polyolefin type, may lead to a phenomenon of creep and thus to a change in the shape of the spray profile over time, with a loss of spray quality.

Documents EP 0 815 946, U.S. Pat. No. 5,439,178, GB 2 007 807, U.S. Pat. No. 3,490,658, U.S. Pat. No. 5,622,318, EP 0 930 102, and U.S. Pat. No. 4,989,790 describe prior-art devices.

Certain Non-Limiting Objects of the Invention

An object of the present invention is to provide a spray head that does not have the above-mentioned drawbacks.

Another object of the present invention is to provide a spray head that is able to withstand drop tests and the creep of materials over time.

Another object of the present invention is to provide a spray head that is simple and inexpensive to manufacture and to assemble, and that is reliable in use for the entire lifetime of the device.

The present invention thus provides a spray head for a fluid dispenser device, said spray head comprising a body that defines an expulsion channel that is terminated by a dispenser orifice, an insert being arranged in said expulsion channel, the end of said insert that is downstream in the flow direction of the fluid co-operating with the downstream end portion of said expulsion channel to define a spray profile, said insert including an elastically-deformable portion that is adapted to deform so as to absorb and/or compensate variations in the dimensions of said body and/or of said insert, and/or so as to compensate deformations and/or movements of said insert in said body, said elastically-deformable portion of the insert comprising tabs that are axially and/or radially deformable, and/or an overmolded portion made of deformable material, and/or one or more radial openings that pass through said insert, and/or at least one sloping strip of deformable material.

Advantageously, said body comprises an inner sleeve that forms the expulsion channel, and an outer body.

In a first advantageous variant, said insert comprises an inner portion that extends in said inner sleeve of said body, and an outer portion that extends out from said inner sleeve of said body, said elastically-deformable portion comprising deformable bridges of material that connect said inner portion to said outer portion.

In a second advantageous variant, said entire insert is arranged inside said inner portion of the body, said insert comprising, in the flow direction of the fluid, an upstream portion and a downstream portion, said elastically-deformable portion interconnecting said upstream and downstream portions.

Advantageously, said upstream portion of the insert is mounted by clamping in said inner portion of the body.

Advantageously, said inner portion of the body includes an inner radial shoulder, said upstream portion of the insert being in abutment against said shoulder so as to hold the insert in said inner portion of the body.

Advantageously, said upstream portion of the insert comes into contact with the dispenser member when the spray head is assembled on said dispenser member.

Advantageously, said elastically-deformable portion of the insert is deformed while the spray head is being assembled on said dispenser member.

Advantageously, said downstream portion of the insert includes a portion of small diameter that is axially offset from the downstream end of said insert, so as to form a chamber in the expulsion channel in the proximity of said spray profile, such that said downstream end of the insert may pivot, at least in part, about said portion of small diameter, generating a ball joint effect.

Advantageously, said elastically-deformable portion of the insert is arranged at the upstream end of said insert.

The present invention also provides a fluid dispenser device comprising a dispenser member, such as a pump, and a spray head as described above, assembled on said dispenser member.

BRIEF DESCRIPTION OF DRAWINGS

These characteristics and advantages and others of the present invention appear more clearly from the following detailed description, given by way of non-limiting example, and with reference to the accompanying drawings, and in which.

DETAILED DESCRIPTION OF NON-LIMITING EMBODIMENTS

Figure 1:
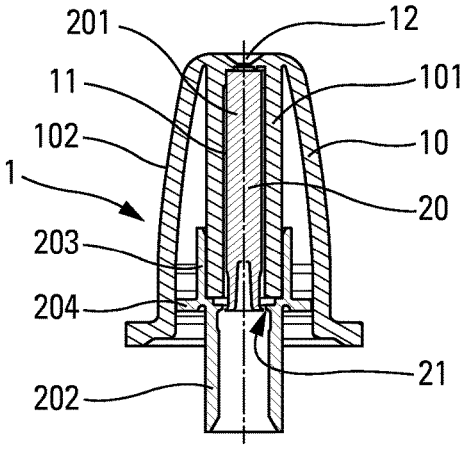
FIGS. 1 to 5 are diagrammatic cross-section views of a spray head in various advantageous embodiments.

The present invention is described with reference to several embodiments. However, the present invention is naturally not limited by the embodiments shown in the drawings.

The present invention, which relates mainly to a particular implementation of a spray profile in a dispenser head of a fluid dispenser device, is suitable for any fluid dispenser device including such a spray profile. However, a particularly advantageous application of the present invention relates to nasal dispenser devices, and the present invention is thus described with reference to a nasal pusher. However, it should be understood that the present invention is not limited to this application example.

In known manner, e.g. from document EP 0 131 501, a spray head 1 comprises a body 10 that incorporates an expulsion channel 11 that extends in said body 10 between an upstream portion for connecting to the dispenser member, e.g. a pump, of the dispenser device on which said spray head 1 is applied, and a downstream end incorporating a dispenser orifice 12. The body 10 may comprise an inner sleeve 101 that defines the expulsion channel, and an outer portion 102. In order to limit the dead volume in the expulsion channel 11 and in order to enable dispensing in the form of spray, an insert 20, also known as an inner nozzle, is placed inside said expulsion channel 11, and preferably extends substantially over a large fraction of said expulsion channel 11. Preferably, said insert 20 fills the volume of the expulsion channel 11 to a large extent, leaving only one or more narrow passages as expulsion channels. Also in known manner, in the flow direction of the fluid, the downstream end of the insert 20 co-operates with the downstream end portion of the expulsion channel 11 (or end wall portion of the expulsion channel) to define a spray profile that promotes dispensing the fluid in the form of a fine spray. The spray profile may be of any shape, but it generally comprises one or more swirl channels that connect the expulsion channel to a central swirl chamber that is arranged immediately upstream from the dispenser orifice.

Figure 4:
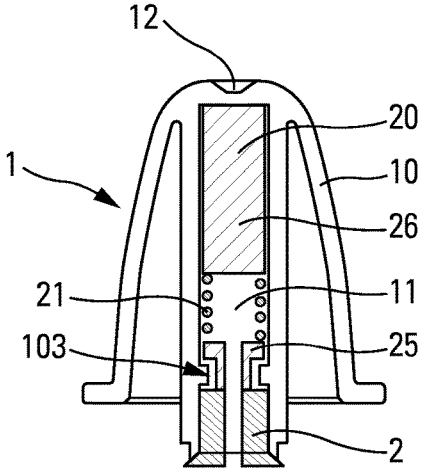
Figure 5:
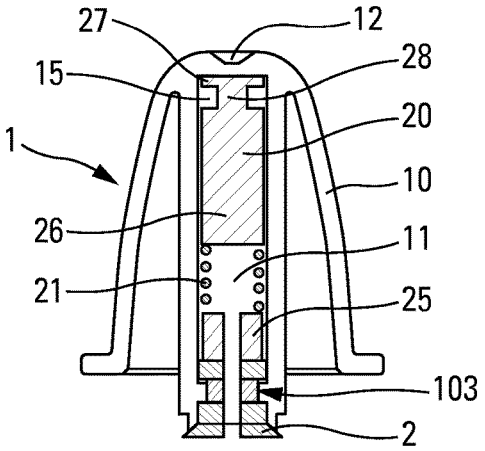

The spray head 1 is for associating with a dispenser member 2, such as a pump, of which a portion is shown diagrammatically in FIGS. 4 and 5.

In the invention, the insert 20 includes an elastically-deformable portion 21 that is adapted to deform, e.g. so as to absorb deformations of the body 10 of the spray head 1, deformations that may be the result of impacts or of the material creep. The elastically-deformable portion 21 of the insert 20 thus generates a spring effect for compensating variations in the dimensions of the body 10 of the spray head 1. The elastically-deformable portion 21 may also act to absorb and/or to compensate variations in the dimensions of said insert 20, and/or to compensate deformations and/or movements of said insert 20 in said body 10, e.g. during a movement of the piston 2 that might cause excess stress on the insert, or to slack, or to movement of said insert.

FIGS. 2 to 5, which are diagrammatic illustrations, show the elastically-deformable portion 21 in the form of a spring, but naturally it is the spring function that is represented diagrammatically, and not the structure itself. FIGS. 1 and 6 to 13 show various possible structural shapes for providing the spring function in the elastically-deformable portion 21 of the insert 20.

The elastically-deformable portion 21 of the insert 20 also provides good definition of the shape of the spray profile by applying a certain amount of bearing force on the downstream end of the insert 20, against the downstream end portion of the expulsion channel 11 (or end wall portion of the expulsion channel). In this way, it is possible, in all circumstances, to guarantee that the insert 20 is correctly positioned in the inner sleeve 101 that defines the expulsion channel 11.

In certain embodiments, which are described below, the elastically-deformable portion 21 of the insert 20 also makes it possible to pre-assemble the insert 20 in the body 10 of the spray head, and to put the insert into contact with the end wall of the spray channel (or, in a variant, to increase the contact force) only when the spray head is assembled on the pump.

FIG. 1 shows an advantageous embodiment in which the elastically-deformable portion 21 is formed by deformable bridges of material that connect an inner portion 201 of the insert 20 that extends inside the inner sleeve 101 of the body 10, to an outer portion 202 of the insert 20 that resides outside said inner sleeve 101. In particular, the outer portion 202 may be fastened on the pump, and may include an axial sleeve 203 that extends axially around a fraction of said inner sleeve 101 of the body 10, and a radial flange 204 that may be in contact with an inside surface of said outer portion 102 of said body 10. However, the axial sleeve 203 and/or the radial flange 204 are not necessarily associated with said deformable bridges of material that connect the inner portion 201 to the outer portion 202. In the event of variations in the dimensions of the body 10, the insert 20 can deform at said deformable bridges of material and thus absorb the variations, while maintaining proper contact with the end wall of the expulsion channel, so as to guarantee the integrity of the spray profile.

In FIGS. 2 to 5, the entire insert 20 is arranged inside the inner sleeve 101 of the body 10, and thus does not include an outer portion as in FIG. 1.

FIGS. 2 to 5 show diagrammatically that, in the flow direction of the fluid, the insert 20 comprises an upstream portion 25 and a downstream portion 26 that are interconnected via said elastically-deformable portion 21.

Figure 2:
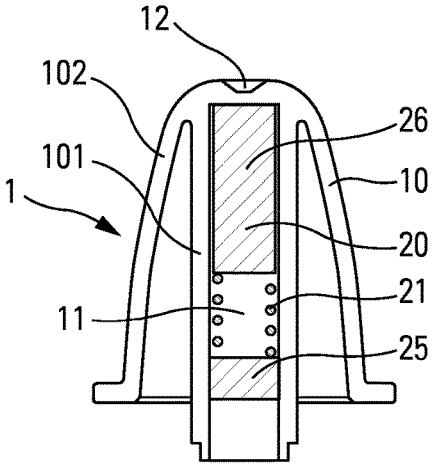

In the embodiment in FIG. 2, the bottom portion is held in the inner sleeve 101 by clamping. Naturally, one or more internal and/or external fluid passages are provided in the bottom portion 25 so as to enable the fluid to pass.

Figure 3:
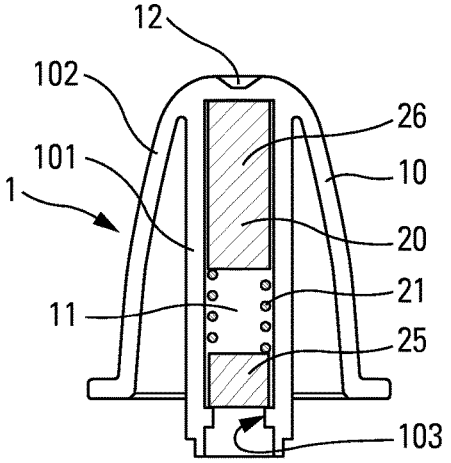

In the embodiments in FIGS. 3 to 5, said inner portion 101 of the body 10 includes an inner radial shoulder 103, said upstream portion 25 of the insert 20 being in abutment against said shoulder 103 so as to hold the insert 10 in said inner portion 101 of the body 10.

More particularly, in FIGS. 4 and 5, said upstream portion 25 of the insert 20 comes into contact with the dispenser member 2, specifically the outlet of the pump, when the spray head 1 is assembled on said dispenser member 2. Advantageously, said elastically-deformable portion 21 of the insert 20 is deformed while the spray head is being assembled on said dispenser member. This makes it possible to optimize the contact between the insert 20 and the body 10, so as to define the spray profile, only at the moment of assembly.

In FIG. 4, the upstream end of the upstream portion 25 of the insert 20 extends beyond the radial shoulder 103, so as to come into contact with the pump during assembly. In FIG. 5, the pump snap-fastens on said radial shoulder 103 of the body 10.

Advantageously, as can be seen in FIG. 5, said downstream portion 26 of the insert 20 may include a portion 28 of small diameter that is axially offset from the downstream end 27 of said insert 20, so as to form a chamber 15 in the expulsion channel 11 in the proximity of said spray profile. Thus, said downstream end 27 of the insert 20 can pivot, at least in part, about said portion 28 of small diameter, generating a ball joint effect that makes it possible to optimize still further the contact between the insert 20 and the end wall of the expulsion channel 11. In particular, this makes it possible to compensate a perpendicularity defect between the insert and the end wall of the head.

FIGS. 6 to 13 show various possible variant embodiments for the elastically-deformable portion 21 of the insert.

In FIGS. 9, 11, 12, and 13, said elastically-deformable portion 21 of the insert 20 comprises tabs 210 that are axially and/or radially deformable. The tabs may include sloping portions that deform both axially and radially so as to generate the spring effect. In particular, the tabs may be arranged at the upstream end of said insert 20.

Figure 10:
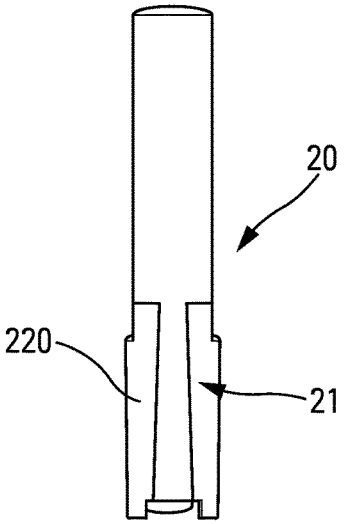
Figure 11:
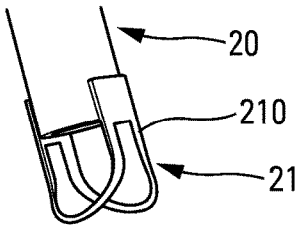
Figure 12:
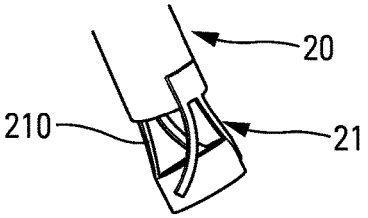
Figure 13:
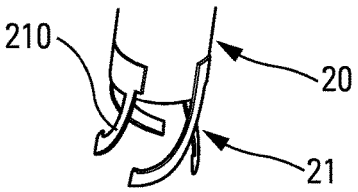

FIG. 10 shows an embodiment in which said elastically-deformable portion 21 of the insert 20 comprises an overmolded portion 220 made of deformable material. The overmolded portion may also be arranged at the upstream end of said insert 20.

Figure 6:
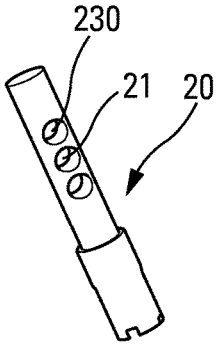
FIGS. 6 to 13 are diagrammatic views of several variant embodiments of an insert usable in a spray head of the invention.

In FIG. 6, said elastically-deformable portion 21 of the insert 20 comprises one or more radial openings 230, specifically three, that pass through said insert 20.

Figure 7:
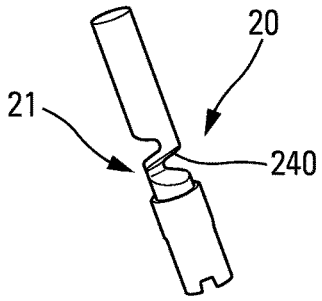
Figure 8:
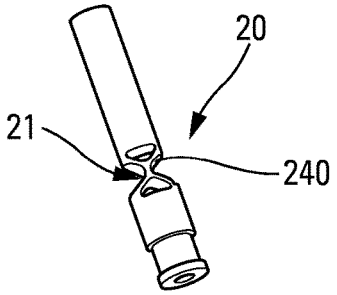
Figure 9:
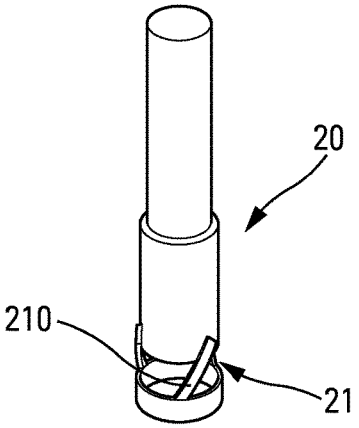

FIGS. 7 and 8 show an elastically-deformable portion 21 of the insert 20 that comprises at least one sloping strip of deformable material 240. In FIG. 7, there is one strip that forms an S-shape, while in FIG. 8, there are two strips that form an X-shape.

Naturally, other embodiments can also be envisaged.

The present invention thus makes it possible to provide a spray head including a spray profile that is particularly suitable for nasal sprays and that presents in particular the following advantages:

- being able to withstand drop tests, in particular those provided in ISO standard 20072, the insert having the ability to absorb violent impacts; and
- eliminating the risks of material creep, the insert being suitable for absorbing the creep stresses exerted thereon by the body of said spray head.

The spray head of the invention, in particular as described above with reference to the figures, is naturally suitable for any appropriate type of fluid dispenser device.

Naturally, the invention is not limited to the embodiments shown in the drawings, and the ambit of the invention is, on the contrary, defined by the accompanying claims.

The invention claimed is:

1. A spray head for a fluid dispenser device for dispensing a fluid, said spray head comprising a body that defines an expulsion channel that is terminated by a dispenser orifice, an insert being arranged in said expulsion channel, an end of said insert that is downstream in a flow direction of the fluid co-operating with a downstream end portion of said expulsion channel to define a spray profile, said insert including an elastically-deformable portion that is adapted to deform so as to absorb and/or compensate variations in the dimensions of said body and/or in said insert, and/or so as to compensate deformations and/or movements of said insert in said body, wherein said elastically-deformable portion of the insert comprises two sloping strips of deformable material that form an X-shape, wherein the two strips cross in a central crossing part to form the X-shape, wherein said body is a one-piece integral construction that comprises an inner sleeve that forms the expulsion channel and an outer body.

2. A head according to claim 1, wherein said entire insert is arranged inside said inner sleeve of the body, said insert comprising, in the flow direction of the fluid, an upstream portion and a downstream portion, said elastically-deformable portion interconnecting said upstream and downstream portions.

3. A head according to claim 2, wherein said upstream portion of the insert is clamped by said inner sleeve of the body.

4. A head according to claim 2, wherein said inner sleeve of the body includes an inner radial shoulder, said upstream portion of the insert being in abutment against said shoulder so as to hold the insert in said inner sleeve of the body.

5. A head according to claim 2, wherein said upstream portion of the insert is adapted to come into contact with a dispenser member when the spray head is assembled on said dispenser member.

6. A head according to claim 5, wherein said elastically-deformable portion of the insert is deformed while the spray head is being assembled on said dispenser member.

7. A head according to claim 2, wherein said downstream portion of the insert includes a portion of small diameter that is axially offset from the downstream end of said insert, so as to form a chamber in the expulsion channel in the proximity of said spray profile, such that said downstream end of the insert may pivot, at least in part, about said portion of small diameter, generating a ball joint effect.

8. A fluid dispenser device comprising a dispenser member and a spray head according to claim 1, assembled on said dispenser member.

9. The head according to claim 1, wherein the X-shape is formed by the two sloping strips of deformable material connecting at the central crossing part to form a common unitary segment and then diverging away from the common unitary segment.

10. The head according to claim 1, wherein the insert is arranged inside the inner sleeve of the body, such that at least a portion of the insert moves within the inner sleeve as a result of deformation of the elastically-deformable portion.

* * * * *